US008395570B2

(12) United States Patent
Maru et al.

(10) Patent No.: US 8,395,570 B2
(45) Date of Patent: Mar. 12, 2013

(54) ACTIVE MATRIX TYPE DISPLAY APPARATUS

(75) Inventors: Hiroyuki Maru, Kawasaki (JP); Tatsuhito Goden, Chiba (JP); Fujio Kawano, Kawasaki (JP); Kouji Ikeda, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 339 days.

(21) Appl. No.: 12/823,235

(22) Filed: Jun. 25, 2010

(65) Prior Publication Data

US 2011/0001689 A1 Jan. 6, 2011

(30) Foreign Application Priority Data

Jul. 1, 2009 (JP) ..... 2009-156749

(51) Int. Cl.
*G09G 3/32* (2006.01)

(52) U.S. Cl. ..... 345/82; 345/52; 345/76; 345/98; 345/87; 345/100

(58) Field of Classification Search ..... None
See application file for complete search history.

(56) References Cited

U.S. PATENT DOCUMENTS

| | | | |
|---|---|---|---|
| 5,302,871 | A | 4/1994 | Matsuzaki et al. |
| 5,963,184 | A | 10/1999 | Tokunaga et al. |
| 6,188,378 | B1 | 2/2001 | Yamamoto et al. |
| 6,335,720 | B1 | 1/2002 | Mori et al. |
| 6,348,910 | B1 | 2/2002 | Yamamoto et al. |
| 6,373,454 | B1 | 4/2002 | Knapp et al. |
| 6,552,709 | B1 * | 4/2003 | Yamaguchi ..... 345/99 |
| 6,559,824 | B1 * | 5/2003 | Kubota et al. ..... 345/100 |
| 6,587,086 | B1 | 7/2003 | Koyama |
| 6,661,180 | B2 | 12/2003 | Koyama |
| 7,126,565 | B2 | 10/2006 | Kawasaki et al. |
| 7,242,397 | B2 | 7/2007 | Iseki et al. |
| 7,253,812 | B2 | 8/2007 | Sasaki |
| 7,259,735 | B2 | 8/2007 | Kasai |
| 7,532,207 | B2 | 5/2009 | Kawasaki et al. |
| 7,605,899 | B2 | 10/2009 | Shikina et al. |
| 7,692,643 | B2 | 4/2010 | Kawasaki et al. |
| 7,812,812 | B2 | 10/2010 | Yoshinaga et al. |
| 7,911,425 | B2 | 3/2011 | Goden et al. |

(Continued)

FOREIGN PATENT DOCUMENTS

| | | | |
|---|---|---|---|
| CN | 1521719 | A | 8/2004 |
| CN | 1770246 | A | 5/2006 |

(Continued)

*Primary Examiner* — Van Chow
(74) *Attorney, Agent, or Firm* — Fitzpatrick, Cella, Harper & Scinto

(57) ABSTRACT

A display apparatus includes a pixel circuit, a scanning line for supplying a scanning signal to the pixel circuit, a data line for supplying a data signal to the pixel circuit, and a shift register circuit having a number of stages, with every stage outputting the scanning signal to the scanning line. In addition, a first power supply supplies a voltage to the shift register circuit, and a second power supply supplies a voltage to the pixel circuit. After the first power supply is turned on, a constant level signal of either "H" or "L" is input into a terminal of the shift register circuit by clocks of the number of stages of the shift register such that every stage of the shift register outputs a same level signal before the second power supply is turned on.

4 Claims, 5 Drawing Sheets

U.S. PATENT DOCUMENTS

| | | | | |
|---|---|---|---|---|
| 2002/0047581 | A1 | 4/2002 | Koyama | |
| 2003/0058687 | A1 | 3/2003 | Kimura | |
| 2004/0155843 | A1 | 8/2004 | Sasaki | |
| 2004/0183752 | A1 | 9/2004 | Kawasaki et al. | |
| 2005/0007316 | A1 | 1/2005 | Akimoto et al. | |
| 2005/0007319 | A1 | 1/2005 | Shin et al. | |
| 2005/0041002 | A1 | 2/2005 | Takahara et al. | |
| 2005/0122150 | A1* | 6/2005 | Iseki et al. | 327/215 |
| 2005/0285151 | A1 | 12/2005 | Kawasaki | |
| 2006/0061529 | A1 | 3/2006 | Kim | |
| 2006/0114194 | A1 | 6/2006 | Kawasaki et al. | |
| 2006/0114195 | A1 | 6/2006 | Yamashita et al. | |
| 2006/0132395 | A1 | 6/2006 | Kawasaki et al. | |
| 2006/0187185 | A1 | 8/2006 | Yoshinaga et al. | |
| 2006/0267509 | A1 | 11/2006 | Yang | |
| 2007/0132719 | A1 | 6/2007 | Yamashita et al. | |
| 2007/0257867 | A1 | 11/2007 | Kasai | |
| 2007/0257868 | A1 | 11/2007 | Kasai | |
| 2008/0007494 | A1 | 1/2008 | Kim et al. | |
| 2008/0157828 | A1 | 7/2008 | Kawasaki et al. | |
| 2008/0158112 | A1 | 7/2008 | Kawasaki et al. | |
| 2008/0259000 | A1 | 10/2008 | Kawasaki | |
| 2009/0015571 | A1 | 1/2009 | Kawasaki et al. | |
| 2009/0033599 | A1 | 2/2009 | Kawasaki et al. | |
| 2009/0066615 | A1 | 3/2009 | Kawasaki | |
| 2009/0085908 | A1 | 4/2009 | Kawasaki et al. | |
| 2009/0102853 | A1 | 4/2009 | Kawasaki et al. | |
| 2009/0109144 | A1 | 4/2009 | Goden et al. | |
| 2009/0121980 | A1 | 5/2009 | Kawasaki et al. | |
| 2009/0121984 | A1* | 5/2009 | Yamamoto et al. | 345/76 |
| 2009/0135110 | A1 | 5/2009 | Nakamura et al. | |
| 2009/0167646 | A1* | 7/2009 | Tanikame | 345/76 |
| 2009/0231239 | A1 | 9/2009 | Goden et al. | |
| 2009/0289966 | A1 | 11/2009 | Ikeda et al. | |
| 2010/0026677 | A1 | 2/2010 | Shikina et al. | |
| 2010/0073267 | A1 | 3/2010 | Akimoto et al. | |
| 2010/0128160 | A1 | 5/2010 | Maru et al. | |
| 2010/0328365 | A1 | 12/2010 | Ikeda et al. | |
| 2011/0001689 | A1 | 1/2011 | Maru et al. | |
| 2011/0025653 | A1 | 2/2011 | Ikeda et al. | |
| 2011/0090210 | A1 | 4/2011 | Sasaki et al. | |

FOREIGN PATENT DOCUMENTS

| | | | |
|---|---|---|---|
| EP | 1 429 312 | A2 | 6/2004 |
| JP | 11-282417 | A | 10/1999 |
| JP | 2001-134229 | A | 5/2001 |
| JP | 2001-159877 | A | 6/2001 |
| JP | 2004-3411144 | A | 12/2004 |
| JP | 2005-157322 | A | 6/2005 |
| JP | 2006-030516 | A | 2/2006 |
| JP | 2008-268981 | A | 11/2008 |
| JP | 2008-015516 | A | 12/2008 |

* cited by examiner

ACTIVE MATRIX TYPE DISPLAY APPARATUS

BACKGROUND OF THE INVENTION

1. Field of the Invention

The present invention relates to a method for resetting a shift register in an active matrix type display apparatus, and frame-narrowing of the active matrix type display apparatus.

2. Description of the Related Art

In an active matrix type display apparatus using organic electroluminescence (hereinafter, called organic EL), crystal liquid or the like, image data is sequentially written (hereinafter, abbreviated as scan) to pixels of a leading row to a final row.

In the scan operation, an SW signal shifts from the top row to the bottom row of pixels synchronously to a clock whenever necessary. The SW signal is input into pixel circuits on a row basis of the display apparatus. The pixel circuit holds a video data signal in the pixel circuit, and according to the held value, a drive transistor outputs a current or a voltage.

Japanese Patent Application Laid-Open No. 2001-159877 proposes a display apparatus provided with a unit therein that generates a signal for resetting each stage of the shift register in order to prevent the output of the shift register from becoming unstable at the time of inputting a power supply and preventing the operation from becoming inaccurate.

Shift register circuits are usually disposed at the end portions of the display apparatuses, and therefore, it is required to simplify the arrangement of the shift register circuits and reduce the occupied areas as the frames of the display apparatuses are narrowed.

SUMMARY OF THE INVENTION

The present invention has an object to provide a display apparatus having a shift register that can be reset at a time of input of power supply and has a simple circuit arrangement.

In order to solve the above described problem, the present invention provides a display apparatus including a data line, a scanning line, a pixel circuit, a shift register circuit, a first power supply for supplying a voltage to the shift register circuit and a second power supply for supplying a voltage to the pixel circuit, wherein one end of the scanning line is connected to an output of the shift register circuit, and writing of a data signal from the data line to the pixel circuit can be controlled by a scanning signal from the scanning line, in a state where the first power supply is on, any one of a high-level signal and a low-level signal is input into the shift register circuit for the number of stages of the shift register, and thereafter, the second power supply is turned on.

According to the present invention, the shift register can be reset while keeping the frame narrow without increasing complexity of the shift register circuit.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Hereinafter, the present invention will be described.

Figure 1:
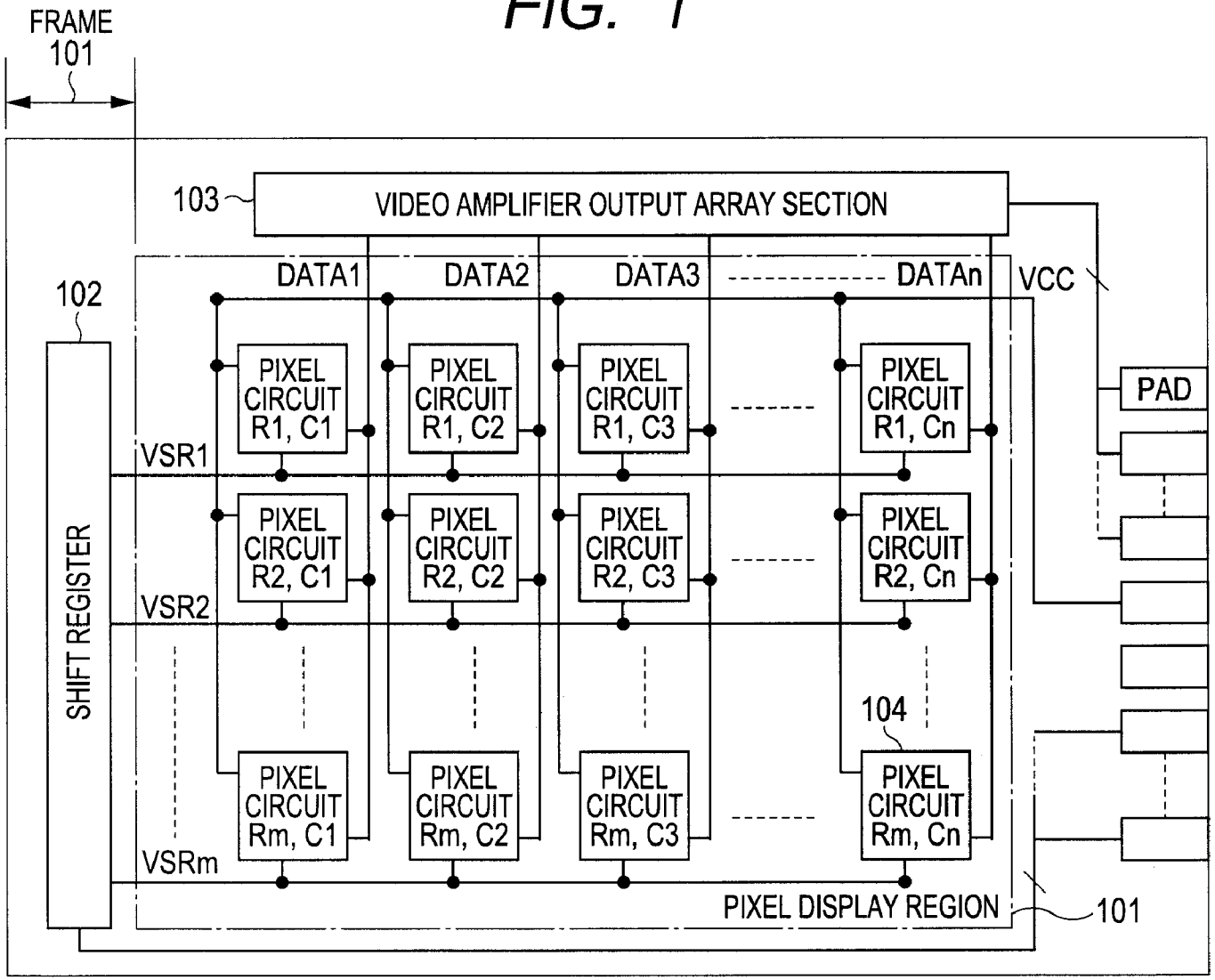
FIG. 1 is a diagram illustrating a display apparatus of embodiment 1.

FIG. 1 is a diagram illustrating one example of a display apparatus of the present invention.

The display apparatus of the present invention has a shift register 102, a power supply to the shift register, a scanning line, a pixel circuit 104, a power supply VCC to the pixel circuit, and a data line. The scanning line has one end connected to an output of the shift register 102, so that writing of a data signal from the data line to the pixel circuit 104 can be controlled by a scanning signal from the scanning line. The scanning signal is generated by output (VSR) of the shift register 102.

Figure 2:
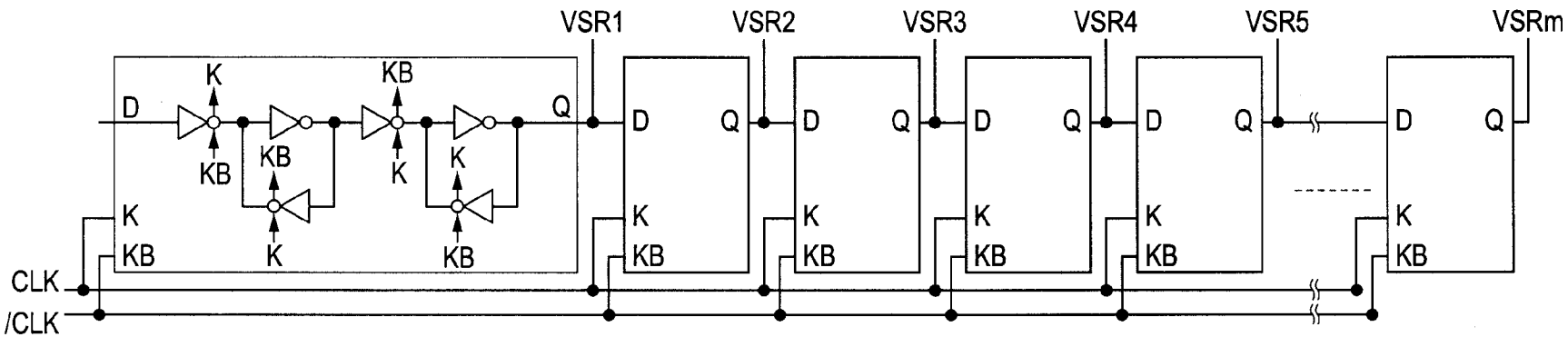
FIG. 2 is a circuit diagram of a shift register of embodiment 1.
Figure 5:
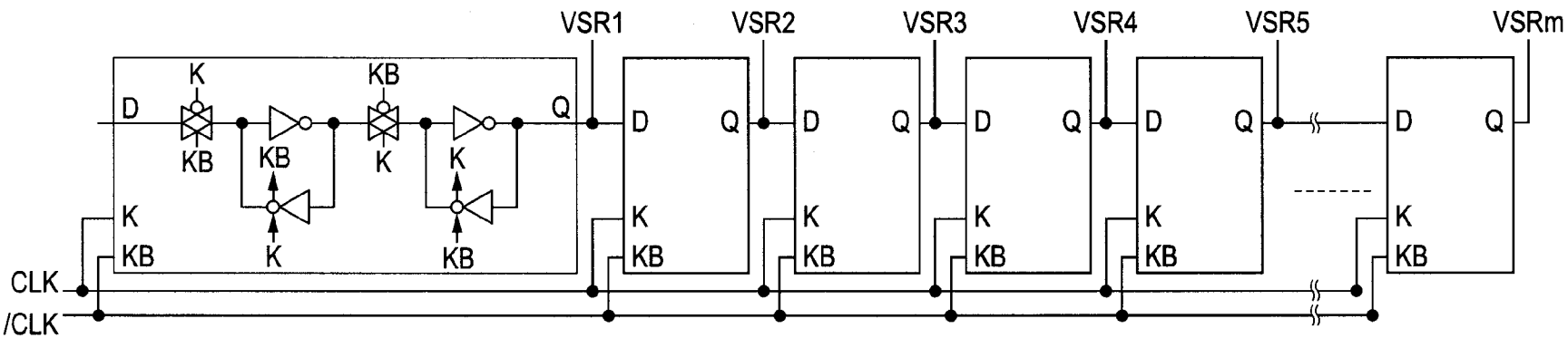
FIG. 5 is a shift register circuit diagram of embodiment 2.

Preferably, as the shift register 102, a circuit in which a plurality of shift registers of one stage are connected may be used, for example. More specifically, the shift register circuits as illustrated in FIGS. 2 and 5 may be used. The shift register 102 is disposed in a frame 105 or the like of a display apparatus. Preferably, as the pixel circuit 104, the circuit of FIG. 3 may be used, for example, and the pixel circuits 104 may be disposed in a two-dimensional matrix form of m rows by n columns (m and n are natural numbers). Hereinafter, all of the respective pixel circuits disposed in the respective pixels of the display apparatus of the present invention will be sometimes collectively described as "pixel circuit section".

Preferably, a plurality of scanning lines and data lines may be used, and the scanning lines and the data lines may be disposed to be orthogonal to each other. Preferably, the scanning line may be connected commonly to the pixel circuits in the row direction, and the data lines may be connected commonly to the pixel circuits in the column direction. Preferably, the pixel in which the pixel circuit 104 is disposed may be disposed at the intersection point of the data line and the scanning line.

The power supply (first power supply) to the shift register and the power supply VCC (second power supply) to the pixel circuits are divided into separate systems, and can be independently controlled.

In the display apparatus of the present invention, a reset operation of the shift register 102 is performed by the following procedure. The details thereof will be described with reference to FIG. 1.

First, with the power supply VCC to the pixel circuits set at a voltage value of 0 V, the power supply to the shift register is turned on (switched to ON).

Next, any one of signals of "H" and "L" is input into the shift register 102 for the number of stages of the shift register 102. By the operation, all the outputs (VSR1 to VSRm) of the shift register 102 are set to "L". The signal which is input into the shift register 102 is a dummy input signal for resetting the shift register 102. Whether the input signal of the shift register 102 is "H" or "L" is determined depending on the number of stages of the inverters for level shift before the input signal is input into the register of each of the stages of the shift register.

After all the outputs (VSR1 to VSRm) of the shift register 102 become "L", the power supply VCC to the pixel circuit section is turned on (is set to a voltage value larger than 0 V).

Subsequently, the signal of "H" is input into the shift register 102 by one stage. By the operation, the outputs (VSR1 to VSRm) of the shift register 102 sequentially become "H" on a row basis with the following clocks.

By the aforementioned reset operation, even when the initial value of the output of the shift register 102 is in an unstable state at the time of input of the power to the shift register, sampling signals (VSR1 to VSRm) for selecting an intended row can be accurately output from the shift register 102.

<Embodiments>

Hereinafter, embodiments of the display apparatus of the present invention will be described.

In embodiments 1 and 2, the case of turning on the light emitting elements emitting light by a current flow will be described, but reset of the shift register can be also carried out with the light emitting elements which emit light by application of a voltage, such as liquid crystal. The light emitting elements which emit light by a current flow may be either an inorganic EL or an organic EL.

<Embodiment 1>

FIG. 1 is a block diagram illustrating the arrangement of the display apparatus of an embodiment of the present invention.

The display apparatus of the present embodiment has the shift register 102, a power supply to the shift register, the scanning line, the pixel circuit section including a plurality of pixel circuits, the power supply VCC to the pixel circuit section, the data line, the video amplifier output array section 103, and a data supply source PAD to the video amplifier output array section.

As the shift register 102, the circuit of FIG. 2 is used, and is disposed in the frame 105 of the display apparatus.

Figure 3:
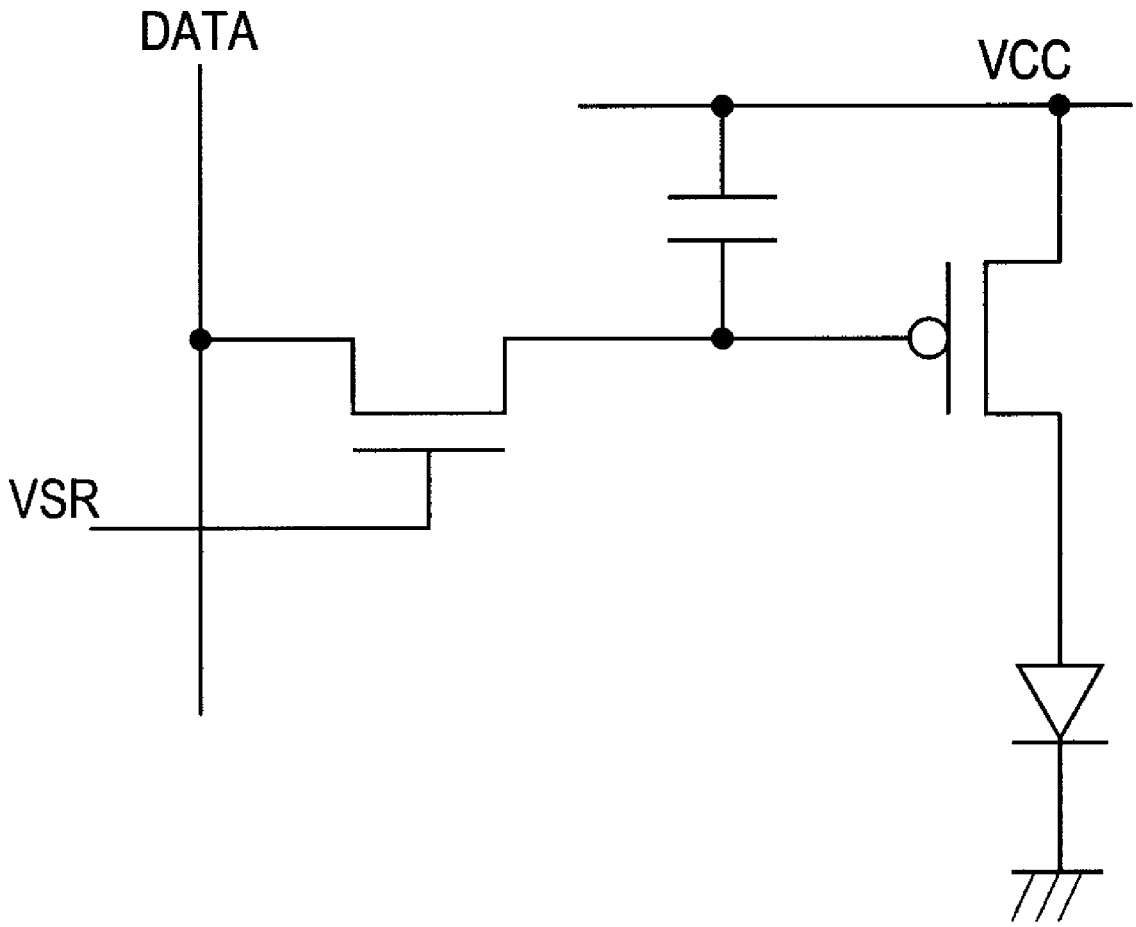
FIG. 3 is a pixel circuit diagram using a current light emitting element.

As the pixel circuit 104, the circuit of FIG. 3 is used, and the pixel circuits 104 are disposed in a two dimensional matrix form. The pixel circuit of FIG. 3 is the one taken out from the pixel circuits of FIG. 1. The pixel circuit of FIG. 3 comprises a transistor NMOS which functions as a switch connecting the data line DATA and a storage capacitor C, the storage capacitor C which holds data, and a drive transistor PMOS which supplies a current to an EL element EL according to the voltage of the storage capacitor C. A gate of the switching transistor NMOS is connected to a scanning line VSR. The power supply VCC to the pixel circuit section and the power supply to the shift register are divided into separate systems and are independently controlled.

The data lines as many as the number of columns of the pixel circuits 104 are prepared, and one ends of the data lines are connected to the corresponding outputs of the video amplifier output array section 103, and the other ends are connected commonly to the pixel circuits 104 of the corresponding columns, so that the data signals (DATA1 to DATAn) are supplied to the pixel circuits 104.

The scanning lines as many as the number of rows of the pixel circuits 104 are prepared, and one ends of the scanning lines are connected to the corresponding outputs of the shift register 102, and the other ends are connected commonly to the pixel circuits 104 of the corresponding columns. The scanning signals are generated by the outputs (VSR1 to VSRm) of the shift register 102, and writing of the data signals to the pixel circuits 104 is controlled by the scanning signals. In order to input the data signal to the pixel circuits 104 of a intended row, the data signals are sampled when the outputs from the shift register 102 (sampling signals (VSR1 to VSRm)) are at a high level, and when the sampling signals are at a low level, the immediately preceding data signals are held.

Figure 4:
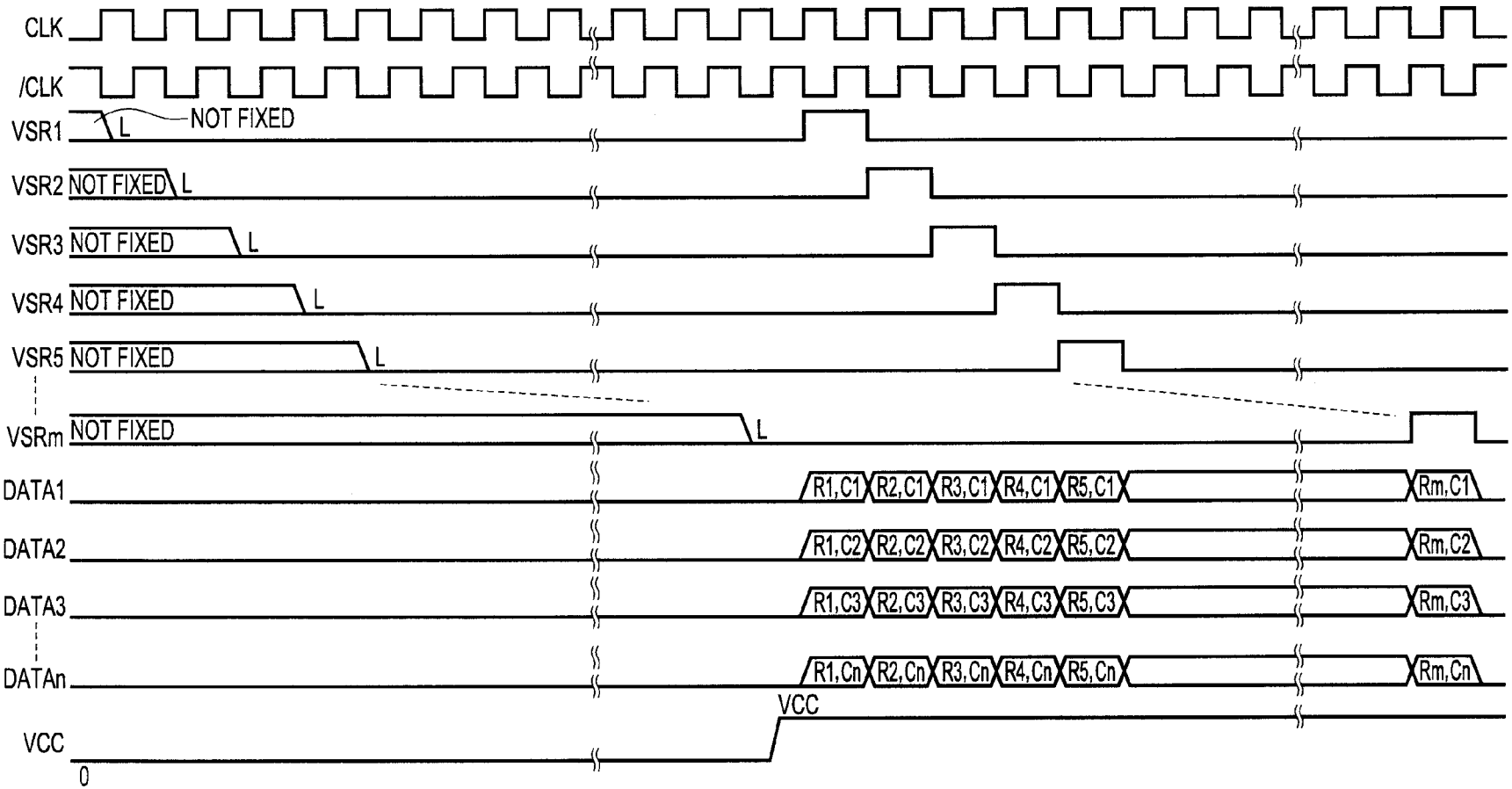
FIG. 4 is a timing chart illustrating a reset operation of the shift register.

According to the timing chart of FIG. 4, the reset operation of the shift register 102 is carried out.

First, the power supply VCC to the pixel circuit section is not turned on with the voltage value remaining 0 V, and the power supply to the shift register is turned on (switched to ON).

Next, synchronously to CLK and /CLK, "L" is input into a terminal D (in FIG. 2) continuously by m clocks (m represents the number of stages of the shift register 102). As a result, all the outputs (VSR1 to VSRm) of the shift register 102 become "L", and the shift register 102 is reset.

After the outputs of the shift register 102 all become "L", the power supply VCC to the pixel circuit section is turned on (set to a voltage value larger than 0 V).

Next, synchronously to CLK and /CLK, "H" is input into the terminal D by one clock pulse, and the data lines (DATA1 to DATAn) are caused to output a data voltage. Thereby, in the following continuing clock, the outputs (VSR1 to VSRm) of the shift register 102 sequentially become "H", and VSR of the pixel circuits can be made "H" on a row basis.

The switching transistors NMOS of the pixel circuits 104 (FIG. 3) of the row the VSR of which is "H" are turned on, the holding capacitors C is charged with the data signal, and according to the voltage, the drive transistors PMOS pass a constant current to the light emitting elements.

When the voltage held by the storage capacitor is set as VGS, a current IEL which flows into the light emitting element is expressed by the following formula.

$$IEL=\beta/2\cdot(VGS-Vth)2 \quad \text{(formula 1)}$$

β: current multiplication factor of PMOS

Vth: threshold voltage of PMOS

Supply of the data signal to a intended pixel circuit is controlled with a program.

As above, in the display apparatus of the present embodiment, the shift register is reset by the data input D, and therefore, a reset signal does not have to be sent to each of the stages of the shift register. Therefore, the shift register can be reset while keeping the frame narrow without increasing complexity of the shift register circuit.

<Embodiment 2>

The display apparatus of the present embodiment is the same as that of embodiment 1 except that a circuit of FIG. 5 is used as the shift register 102. The circuit of FIG. 5 is adapted by changing the clocked inverter circuit of input of the circuit of FIG. 2 to an analog switch, and changing the number of elements of the shift register 102 corresponding to one stage to 16 elements.

The reset operation of the shift register 102, the control method of the power supply VCC to the pixel circuit and the programming method of the data signal are the same as those of embodiment 1.

According to the timing chart of FIG. 4, the reset operation of the shift register 102 is carried out. At this time, the signal of "L" is input as a dummy input signal, and the dummy input signal becomes either "H" or "L" depending on the polarity that turns off the NMOS SW of the pixel circuit 104 (FIG. 3).

As above, in the display apparatus of the present embodiment, the shift register is reset by the data input D, and therefore, a reset signal does not have to be sent to each of the stages of the shift register. Therefore, similarly to embodiment 1, the shift register can be reset while keeping the frame narrow without increasing complexity of the shift register circuit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-156749, filed Jul. 1, 2009, which is hereby incorporated by reference herein in its entirety.

What is claimed is:

1. A display apparatus comprising:

a pixel circuit, a scanning line for supplying a scanning signal to the pixel circuit;

a data line for supplying a data signal to the pixel circuit;

a shift register circuit having a number of stages, with every stage outputting the scanning signal to the scanning line;

a first power supply for supplying a voltage to the shift register circuit; and a second power supply for supplying a voltage to the pixel circuit, wherein after the first power supply is turned on, a constant level signal of either "H" or "L" is input into a terminal of the shift register circuit by clocks of the number of stages of the shift register such that every stage of the shift register outputs a same level signal before the second power supply is turned on.

2. The display apparatus according to claim 1, wherein the pixel circuit comprises a switch connecting the data line and a storage capacitor C in the control of the scanning line, the storage capacitor C which holds the data signal, and a PMOS transistor which supplies a current to an EL element according to the voltage of the storage capacitor C.

3. The display apparatus according to claim 2, wherein the same level signal output by the shift register makes the switch of the pixel circuit turn off.

4. The display apparatus according to claim 1, wherein, after the second power supply is turned on, a level signal of "H" or "L" different than the constant level signal is input by one clock into a terminal of the shift register circuit with following continuing clocks, thereby the shift register sequentially outputs on a row basis a level signal different than the same level signal.

* * * * *